United States Patent [19]

Ito et al.

[11] 4,323,306

[45] Apr. 6, 1982

[54] DEVELOPER CLEANING DEVICE FOR ELECTROPHOTOGRAPHY

[75] Inventors: Yoshio Ito; Katuhiko Yamada; Tadayuki Kitajima, all of Yokohama; Koichi Miyamoto, Tokyo; Hiroo Kobayashi, Tokyo; Yoshikuni Mohvama, Tokyo, all of Japan

[73] Assignee: Canon Kabushiki Kaisha, Tokyo, Japan

[21] Appl. No.: 91,483

[22] Filed: Nov. 5, 1979

Related U.S. Application Data

[63] Continuation of Ser. No. 934,688, Aug. 17, 1978, Pat. No. 4,218,131, which is a continuation of Ser. No. 648,821, Jan. 13, 1976, abandoned.

[30] Foreign Application Priority Data

Jan. 17, 1975 [JP] Japan ..... 50/7528

[51] Int. Cl.[3] ..... G03G 21/00

[52] U.S. Cl. ..... 355/15; 15/256.51; 355/3 DD; 366/310

[58] Field of Search ..... 355/15, 3 DD; 15/1.5 R, 15/1.5 A, 256.5, 256.51, 256.52; 118/652; 366/186, 195, 196, 310; 222/DIG. 1, 230, 234

[56] References Cited

U.S. PATENT DOCUMENTS

| | | | |
|---|---|---|---|
| 3,678,896 | 7/1972 | Hewitt | 355/15 X |
| 3,740,789 | 6/1973 | Ticknor | 355/15 |
| 3,917,398 | 11/1975 | Takahashi et al. | 355/15 |
| 4,007,982 | 2/1977 | Stange | 355/15 |
| 4,030,824 | 6/1977 | Smith | 355/15 |

*Primary Examiner*—Richard L. Moses

*Attorney, Agent, or Firm*—Fitzpatrick, Cella, Harper & Scinto

[57] ABSTRACT

A cleaning device for removing developer from the surface of a reusable and movable image bearing member comprises a cleaning member which extends transversely of the movement direction of the image bearing member, a device for transporting the removed developer along the transverse direction, a passageway for leading the transported developer to a collecting element, and a rotatable helical member for preventing the deposition of the removed developer on the passageway.

27 Claims, 16 Drawing Figures

DEVELOPER CLEANING DEVICE FOR ELECTROPHOTOGRAPHY

This is a continuation, of application Ser. No. 934,688, filed Aug. 17, 1978, now U.S. Pat. No. 4,218,131 which in turn is a continuation of U.S. Ser. No. 648,821, filed Jan. 13, 1976, now abandoned.

BACKGROUND OF THE INVENTION

1. Field of the Invention

This invention relates to a cleaning device for cleaning a toner-image-bearing member such as photosensitive medium or the like to remove residual developer therefrom, and more particularly to improvements in such as cleaning device which uses a blade of resilient material.

2. Description of the Prior Art

The blade cleaning method utilizing a blade of resilient material is such that the edge of a blade formed of a wear-resisting resilient material such as rubber or the like frictionally slides relative to the surface of an image-bearing member such as photosensitive medium for electrophotography to thereby remove any residual substance including residual developer remaining on that surface.

This method, as compared with the conventional fur brush cleaning method, is higher in cleaning efficiency, and particularly so for the smooth-surfaced photosensitive medium in electrophotographic copying apparatus, for example, Se photosensitive medium or other photosensitive medium provided with an insulating layer of mylar or like material. Further, it eliminates the need for high-speed rotation which is required in the fur brush method, and it is also very simple in construction.

This leads to a very simple and compact construction of the device for carrying out such cleaning method, which in turn means very high effectiveness for large copying machines as well as small copying machines for office work.

In view of such effectiveness of the blade cleaning method, the applicant has studied, developed and proposed various types of arrangement for it. One of them is disclosed in detail in U.S. Pat. No. 3,859,691 by Katayama et al. and such an arrangement is shown in FIG. 1 of the accompanying drawings wherein the device is disposed sidewise of a photosensitive drum 1 to cause a blade 2 to scrape off developer D from the surface of the photosensitive drum rotating upwardly and the scraped-off developer drops from gravity into an underlying container 3 for collection therein. In such arrangement, the developer removed by the blade edge drops without building up on the edge portion, thus ensuring a good cleaning effect. This arrangement, however, restricts the position of the device to the area sidewise of the photosensitive drum. Especially, in view of the fact that the developing device is situated in underlying relationship with the photosensitive drum and an image transfer device or the like is adjacent thereto, it has structurally been quite restrictive in making the entire apparatus compact that the cleaning device occupies the position sidewise of the photosensitive drum.

An arrangement as shown in FIG. 2 of the accompanying drawings wherein the cleaning device is situated not sidewise of but above the photosensitive medium is structurally very effective. However, the simple overlying relationship of the blade with the photosensitive drum might permit developer to be stagnant on the blade portion, thus impeding the cleaning efficiency.

Even such as arrangement will still be effective if it is incorporated in the apparatus disclosed in U.S. Pat. No. 3,917,398 by Takahashi et al. As shown in FIG. 3 of the accompanying drawings which shows a side view of the arrangement, a cleaning blade 6 is urged against the surface of a photosensitive medium 5 provided over a drum 4. Disposed adjacent to the blade is a guide plate 7 which may be in slight pressure contact or in closely spaced apart relationship with the photosensitive medium. By the setting of this guide plate, toner particles such as removed developer and the like (hereinafter referred to as removed toner) are forced upwardly through the gap between the blade edge portion and the guide plate edge portion. The removed toner may of course be collected from the guide plate by appropriate means.

FIG. 4 of the accompanying drawings shows, in perspective view, an apparatus provided with such as cleaning device. A lead screw 8 for conveying removed toner is disposed over the clearance between the blade 6 and the guide plate 7 to convey the removed toner laterally. A delivery duct 9 is provided to guide and collect therethrough the removed toner conveyed by the screw 8 into the developer reservoir 11 of a developing device 10. Such a construction enables highly efficient cleaning.

However, it has been found that the attempt to reuse the removed toner by providing the cleaning device above the photosensitive drum encounters several problems.

Firstly, the toner removed by the blade edge portion is forced upwardly through the gap between the blade and the guide plate while spreading laterally along the blade edge, namely, axially of the drum. Thus, as viewed in FIG. 4, rather than at this end of the blade 6 connected to the duct 9 leading to the developing device 10, at the other end of the blade, the laterally moving toner will leak and scatter from said other end of the blade and/or the drum, resulting in contamination of the interior of the apparatus.

Secondly, scattering of the toner will also occur even at the delivery end of the blade which is adjacent to the duct 9. In the arrangement as shown in FIG. 4, the toner forced upwardly onto the cleaning blade 6 is advanced toward this side on the blade and on the guide plate 7 by the screw 8 and drops into the duct 9 at the point beyond this end of the photosensitive drum 5, and part of the toner will scatter upwardly when such drop occurs. Incidentally, for the mounting or dismounting of the photosensitive drum 5 or the cleaning device, the cleaning blade 6 and guide plate 7 must be separated from the drum 5 and usually the blade 6 and guide plate 7 are movably mounted by means of shafts 12 and 13, respectively. Thus, the cleaning blade 6 and duct 9 are movable relative to each other. Also, the guide plate 7 must keep uniform slight pressure contact with the photosensitive drum due to gravity or the like, and any strong contact thereof with other part which would impart non-uniform force to the guide plate is undesirable. For these reasons, it is difficult to provide complete sealing for the delivery portion between the cleaning blade 6 and the guide plate 7 and the duct 9, whereas any gap present in such portion would also permit the upwardly scattered toner in the delivery portion to leak therethrough and contaminate the interior of the apparatus.

In the gap between the blade edge and the guide plate, part of the toner is moved toward this side on the photosensitive drum 5 and drops into the duct 9 at this end of the photosensitive drum. Therefore, sealing is also requird between the duct 9 and this end of the photosensitive drum 5, but the requirement of rotatability of the photosensitive drum makes it difficult to provide complete sealing for such portion and thus, toner may also scatter therefrom to contaminate the interior of the apparatus.

Thirdly, the need to remove the photosensitive drum or the cleaning device from the apparatus arises from the purpose of maintenance and during such removal, a great deal of toner in the cleaning device may drop through the gap between the cleaning blade 6 and the guide plate 7 extremely contaminate the interior of the apparatus and even the neighboring floor or the like.

Further, when the cleaning device has been removed from the apparatus, the apparatus may be displaced or tilted to cause the toner on the cleaning blade and/or the guide plate to drop from a side edge thereof and contaminate the floor or the like.

In view of these, the present invention has been made.

SUMMARY OF THE INVENTION

It is an object of the present invention to provide an improved blade type cleaning device.

It is another object of the present invention to provide a compact cleaning device which permits developer after the cleaning to be collected without being scattered.

It is still another object of the present invention to provide a cleaning device so constructed as to prevent scattering of collected developer during mounting or dismounting of the device.

Generally describing the construction of the present invention, it is characterized by wiper means having a resilient blade member bearing against the surface of an image-bearing member to be cleaned, guide means having a guide member having one end edge opposed to the bearing end edge of the resilient blade of said wiper means, the guide means cooperating with the wiper means to define an opening through which removed substance may flow, and seal means for forming a sealed conveyance path between said opening and an outlet port through which the introduced substance may be discharged out of the device.

Other objects and features of the present invention will become fully apparent to any person skilled in the art from the following detailed description of some specific embodiments thereof taken in conjunction with the accompanying drawings.

DESCRIPTION OF THE PREFERRED EMBODIMENTS

Figure 1:
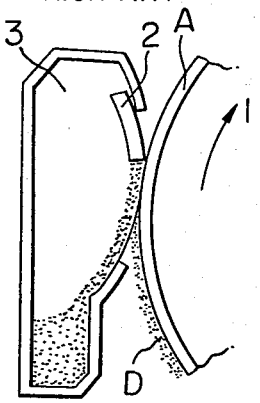
FIG. 1 PRIOR ART
FIG. 1 is a side view showing a conventional form of the blade cleaning device to which the present invention pertains.
Figure 2:
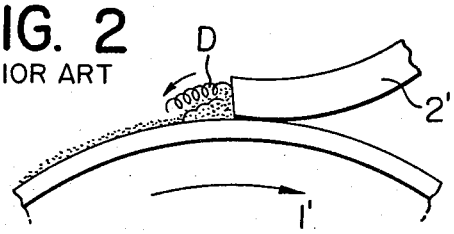
FIG. 2 PRIOR ART
FIG. 2 is a side view showing another conventional form of the cleaning device in which the cleaning blade is situated above the photosensitive medium.
Figure 3:
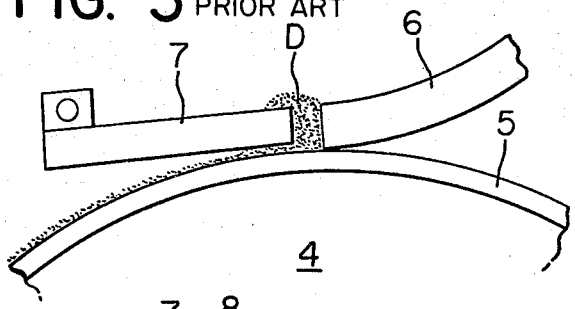
FIG. 3 PRIOR ART
FIG. 3 is a side view illustrating the blade cleaning device to which the present invention pertains.
Figure 4:
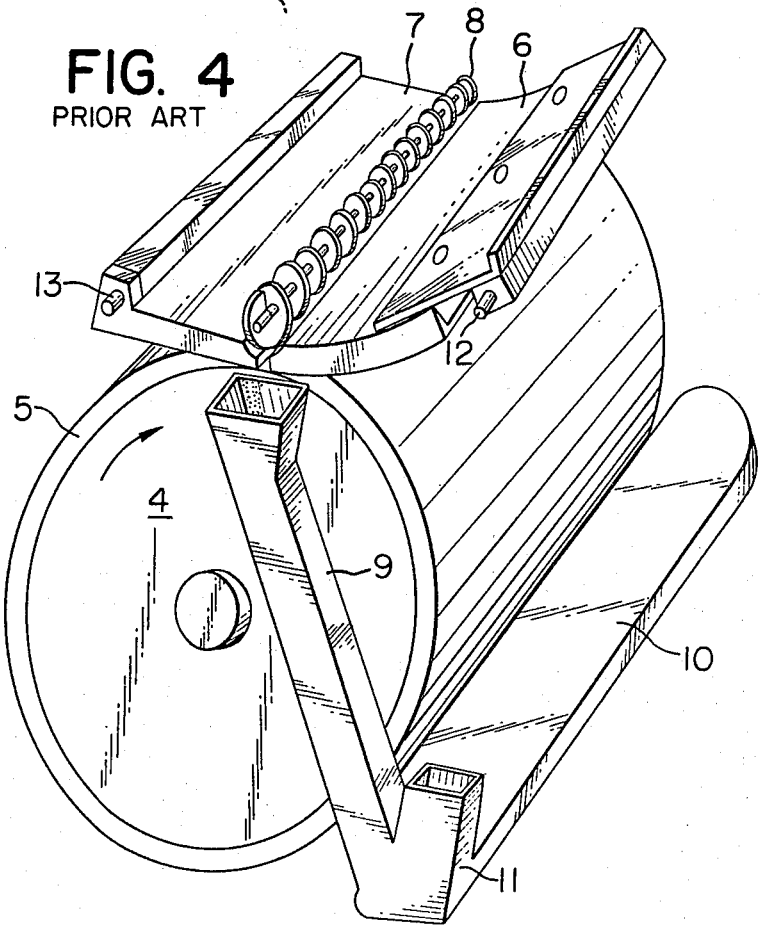
FIG. 4 PRIOR ART
FIG. 4 is a perspective view showing the essential portions of a copying apparatus which incorporates the cleaning device of FIG. 3.
Figure 5:
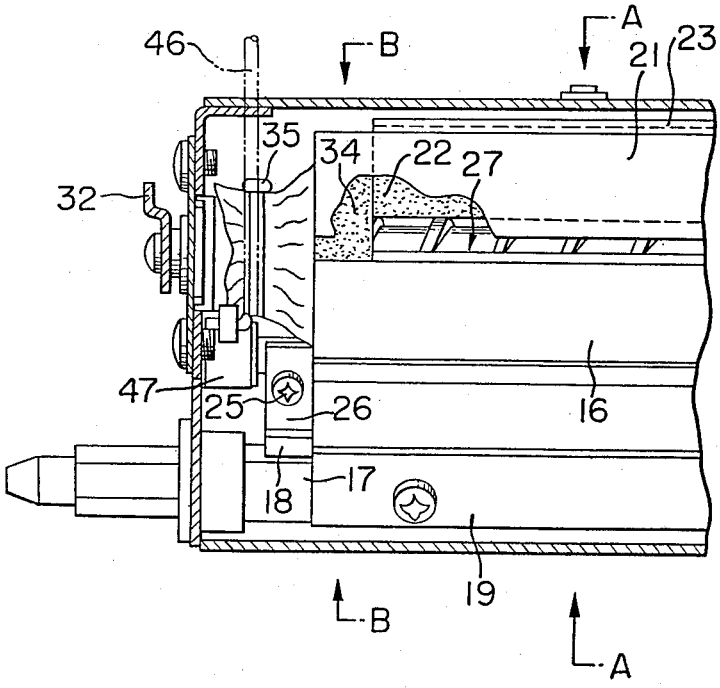
FIG. 5 is a fragmentary plan view of the device according to an embodiment of the present invention.
Figure 6:
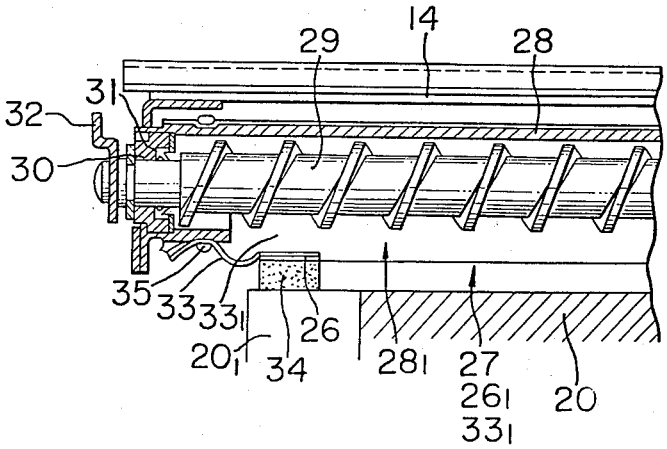
FIG. 6 is a front view of the same device.

An embodiment of the device according to the present invention will hereinafter be described by reference to the fragmentary plan view of FIG. 5, the front view of FIG. 6 and the cross-sectional views of FIGS. 7 and 8. A casing 14 for the cleaning device has an engaging member $\mathbf{14_1}$ engageable with a rail 15 secured to the body of a copying apparatus, thus making the cleaning device removable from the apparatus body.

A blade 16 is nipped by and between adapters 18 and 19 and mounted on a shaft 17. By rotating the shaft 17 counterclockwise to lock the blade, the end edge portion of the blade 16 may be urged against a photosensitive drum 20 which is rotating clockwise. Cleaning of the photosensitive drum 20 may be accomplished by the sharp end edge portion $\mathbf{16_1}$ of the blade 16.

A guide plate 21, which keeps an appropriate gap $\mathbf{16_2}$ with respect to the blade edge portion $\mathbf{16_1}$, may be formed of a thin sheet of such material as Mylar or the like, and is suspended from a shaft 24 substantially at the center of the longitudinal dimension of the drum 20 by means of a resilient member 22 of urethane foam or like material and a back metal 23. This ensures uniform contact of the guide plate 21 with the photosensitive drum 20.

A suitably resilient sheet 26 secured to the adapter 18 by a screw 25 is sandwiched at one end portion between the blade 16 and the adapter 18. The other end portion of the sheet 26 is sandwiched between the resilient member 22 on the guide plate 21 and the back metal 23 and secured to the latter. The end portion $\mathbf{21_1}$ of the guide plate 21 is vertically movable with vertical movement of the blade 16. The sheet 26 is formed with a window $\mathbf{26_1}$ having a width substantially conforming to the gap 27 between the blade 16 and the back metal 23.

A screw 29 accommodated within a pipe 28 is disposed substantially above the blade edge portion $\mathbf{16_1}$. The pipe 28 has a window $\mathbf{28_1}$ at a portion thereof which faces the blade edge portion $\mathbf{16_1}$. The screw 29 is supported and sealed at the opposite ends of the pipe 28 by bearings 30 and seals 31, and rotatively driven from a drive source (not shown), which is common to the photosensitive drum 20, through a lever 32 attached to one end of the pipe.

A flexible wrap sheet 33 (which may be formed of, for exaple, Mylar) extends over the window $\mathbf{26_1}$ of the sheet 26 and the window $\mathbf{28_1}$ of the pipe 28 and is secured to the sheet 26 and the pipe 28, thus forming a sealed cylindrical chamber or space $33_1$. The wrap sheet 33 has a window $33_1$ at a portion which is also substantially in conformity with the window $26_1$ of the sheet 26.

Figure 8:
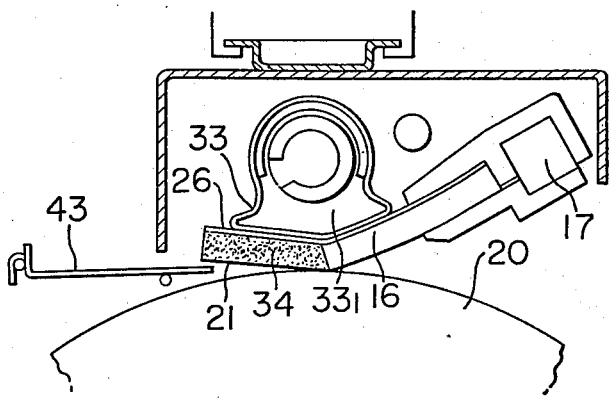
FIG. 8 is a side cross-sectional view taken along line B—B in FIG. 5.

On the other hand, as shown in FIG. 8, a resilient seal 34 of urethane foam or like material secured to the sheet 26 extends into intimate contact with the end edge of the blade 16 near the opposite side edges thereof corresponding to the non-image-bearing area $20_1$ of the photosensitive drum 20, and the resilient seal 34 frictionally slides relative to the photosensitive drum 20 while making intimate contact therewith, whereby the gaps $16_2$ and 27 defined by the blade 16, the guide plate 21 and the back metal 23 are closed at the opposite ends thereof.

The windows $26_1$ and $33_1$ of the sheet 26 and the wrap sheet 33, respectively, terminate substantially in conformity with the position of the resilient seal 34.

The cylindrical wrap sheet 33 has the opposite ends thereof tied to the pipe 28 by bands 35 to close the opening of the cylindrical space $33_1$.

With the above-described construction of the cleaning device, the toner removed by the blade edge portion $16_1$ is forced upwardly through the gap $21_1$ between the blade and the guide plate 21 to fill the space $33_1$ within the wrap sheet 33. Subsequently, the toner is conveyed forwardly through the pipe 28 by the rotating screw 29. At the same time, that part of the toner which spreads axially of the drum along the blade edge portion $16_1$ at the opposite side edges thereof, as already mentioned, is prevented from further advancing by the resilient seal 34 and also forced upwardly into the overlying space $33_1$. Since the space $33_1$ is closed at the opposite ends thereof by the bands 35, the toner filling the space $33_1$ is all conveyed forwardly through the pipe 28 without leaking outwardly. Thus, there is no contamination of the apparatus interior which would otherwise result from scattered toner near the opposite ends of the photosensitive drum 20.

Figure 9:
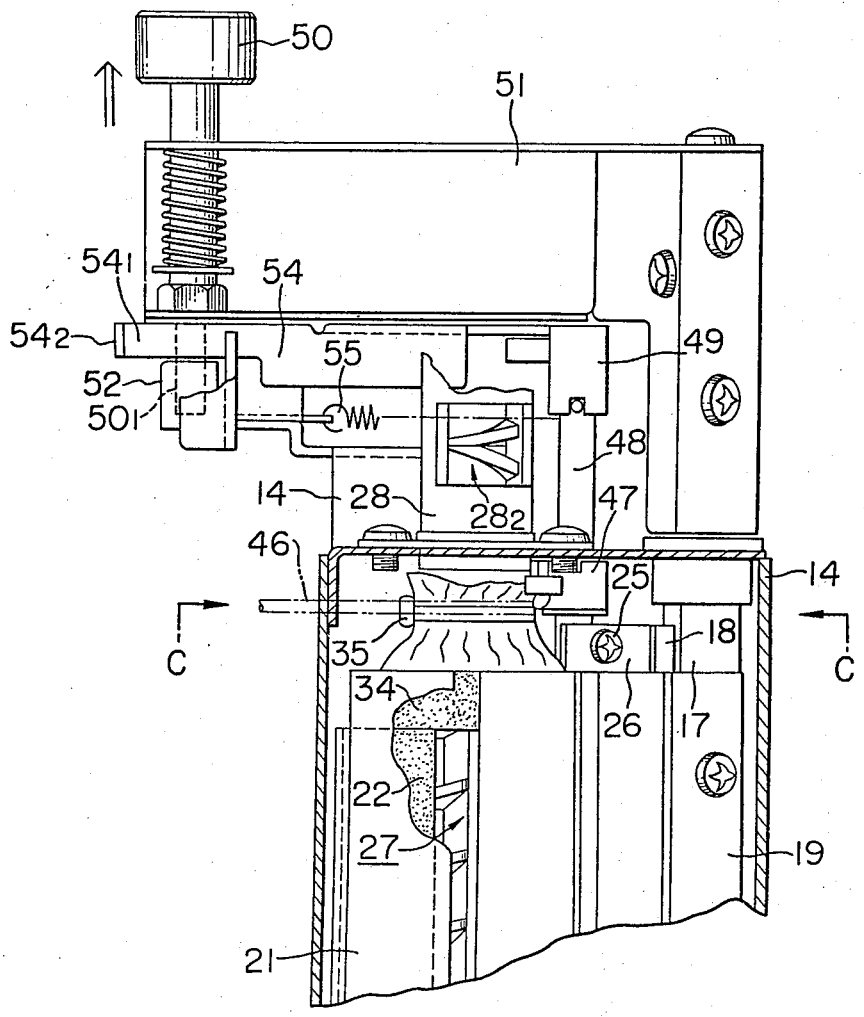
FIG. 9 is a fragmentary plan view of the end portion of the device which is opposite to that shown in FIG. 5.

Description will now be made of a mechanism for preventing the toner within the space $33_1$ from dropping through such opening as the gap $16_2$ between the blade 16 and the guide plate 21 when the cleaning device is in non-cleaning condition such as inoperative condition or when it is being mounted or dismounted. FIG. 9 is a fragmentary plan view illustrating the operative position of such mechanism, FIG. 10 is a side view thereof, FIG. 11 is a cross-sectional view along line C—C in FIG. 9, and FIG. 12 illustrates the operative condition of the present mechanism in the cross-sectional view of FIG. 7.

A shutter 43 has a length (axial) equal to or slightly greater than that of the blade 16, and is situated between the guide plate 21 and the photosensitive drum 20. As shown in FIG. 11, it is supported by a shaft 46 at one end and also supported from therebelow for movement on a support member 44. The shaft 46 is extended rightwardly as viewed in FIG. 11 and engages each of shutter arms 47 provided within the casing 14 at the opposite ends thereof. Each shutter arm 47 is secured to a rotatable shaft 48 extending through the casing 14 laterally thereof, and a shutter lever 49 is secured to that portion of the shaft 48 which is projected beyond the casing 14. With such construction, the shutter 43 may be substantially horizontally moved to right and left in FIG. 10 or 11 by moving the shutter lever 49 sidewise from its position shown in FIG. 10.

Figure 7:
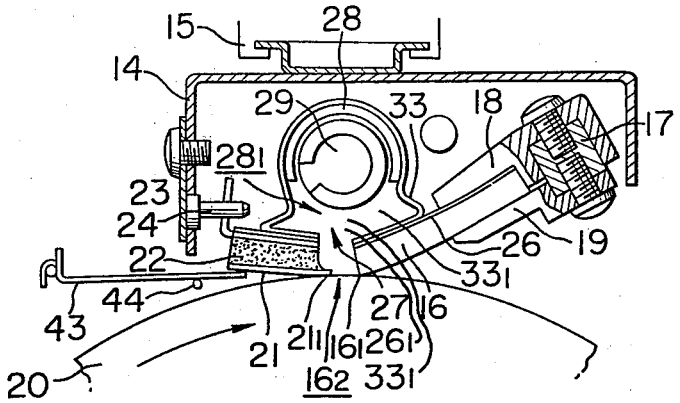
FIG. 7 is a side cross-sectional view taken along line A—A in FIG. 5.
Figure 10:
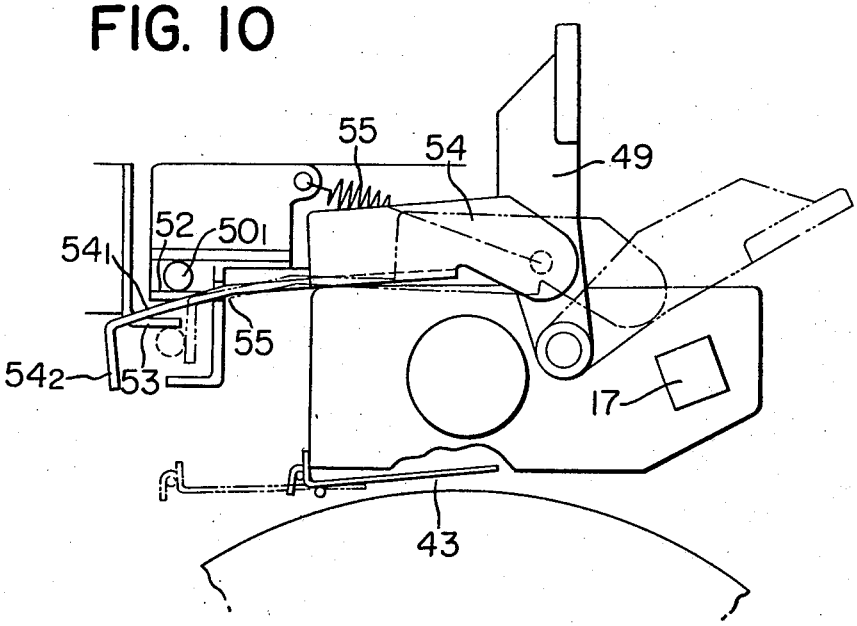
FIG. 10 is a side elevation of the FIG. 9 portion.
Figure 11:
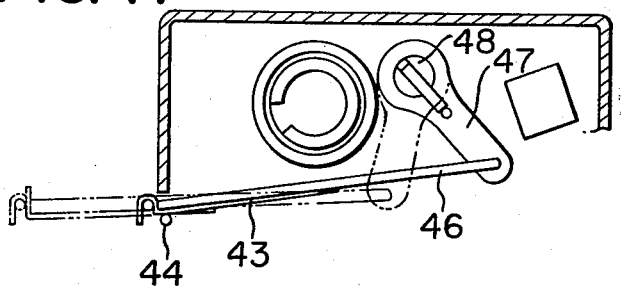
FIG. 11 is a cross-sectional view taken along line C—C in FIG. 9.
Figure 12:
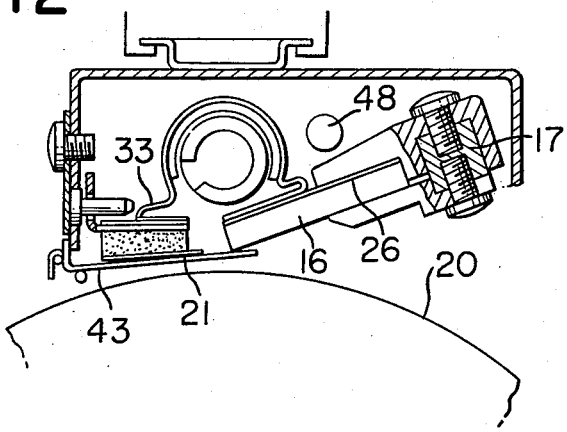
FIG. 12 illustrates the operative conditions of the portions shown in the cross-sectional view of FIG. 7.

When the cleaning device is in its cleaning position, the shutter lever 49 is pivoted clockwise in FIG. 10 (the position indicated by dot-and-dash line), whereby the shutter 43 is displaced leftwardly as indicated by dots-and-dash line in FIG. 11 or in solid outline in FIG. 7 (the "open" position of the shutter 43), thus making no interference with the cleaning operation.

Subsequently, the shaft 17 is rotated by means of a knob 50 and a lever 51 (FIG. 13) on the front of the device shown in FIG. 9, to thereby raise the blade 16 away from the photosensitive drum 20, whereupon the edge portion of the guide plate 21 is also raised by the described action of the sheet 26. When the shutter lever 49 is then pivoted back to the solid-line position shown in FIG. 10, the shutter 43 is displaced rightwardly so that the forward end thereof passes below the blade edge portion $16_1$ and is finally raised slightly due to the angular movement of the shutter arm 47. By this, the upper surface of the shutter 43 is urged against the blade edge portion $16_1$ and also against the guide plate 21 and the resilient seal 34 at the opposite ends (the "closed" position of the shutter 43). Thus, the lower opening $16_2$ of the cleaning device is completely sealed to prevent dropping of the toner perfectly. A slight amount of toner would then remain on the photosensitive drum 20, but such slight amount of toner would not slip down the surface of the photosensitive drum to contaminate the interior of the apparatus.

By bringing the shutter 43 into "closed" position as described, the toner cannot drop from anywhere even if the present device is tilted during the removal thereof from the apparatus, because the toner at the opening $16_2$ is blocked by the shutter 43 and the toner on the blade 16 and the guide plate 21 is blocked by the seal at the opposite ends of the wrap sheet 33.

The device according to the present embodiment of the invention further incorporates therein a safety mechanism for the shutter mechanism. If one tries to lower the blade 16 with the shutter remaining in "closed" position or to close the shutter 43 with the blade 16 remaining lowered, then there will be a possibility that damages may be imparted to the shutter 43, the guide plate 21, the blade 16, the photosensitive drum 20, etc. In the present embodiment, therefore, a knob 50 for controlling the blade 16 and the shutter lever 49 for controlling the shutter 43 are associated together to prevent malfunctioning.

The end portion $50_1$ of the knob 50 lies on an arm rest 52 provided on the casing 14 when the blade 16 is in raised position. To lower the blade 16 to urge it against the photosensitive drum, the know 50 is first pulled upwardly in FIG. 9 to cause the end portion $50_1$ thereof to escape from the arm rest 52, and then the knob 50 is depressed downwardly in FIG. 10 to cause the arm 51 to rotate the shaft 17 counter-clockwise to urge the blade and finally, the end portion $50_1$ of the knob is forced in to underlie pressure plate 53 (in FIG. 9, the knob 50 is depressed back), thus accomplishing the setting (the dots-and-dash line position in FIG. 10). In order to associate such movement with the movement of the shutter lever 49, a link 54 is pivotally supported on the shutter lever 49. The other end portion of the link 54 extends to the neighborhood of the end portion $50_1$ of the knob 50 and is slidable in a groove 55 formed in the casing 14.

When the blade 16 is in raised position with the shutter 43 in "closed" position (the solid-line position of FIG. 10), the upper surface $54_1$ of the end of the link 54 may interfere with the path followed by the end portion $50_1$ of the knob 50 as the blade 16 is lowered. Thus, the blade 16 cannot be lowered when the shutter 43 is in "closed" position.

Next, when the shutter lever 49 is pivoted rightwardly to bring the shutter 43 into "open" position, the link 54 is displaced rightwardly in FIG. 10 to cause the upper surface $54_1$ of the end portion of the link to escape from the path of the end portion $50_1$ of the knob (dot-and-dash line), thus permitting the blade 16 to be lowered.

When the blade 16 is in its lowered position, namely, when the end portion $50_1$ of the knob underlies the pressure plate 53, the bent end $54_2$ of the link 54 strikes against the end portion $50_1$ of the knob so that the shutter 43 cannot be "closed" by cocking up the shutter lever 49.

When the knob 50 is lifted to return the end portion $50_1$ thereof onto the arm rest 52 (namely, when the blade 16 is raised), the interference of the bent end $54_2$ of the link is eliminated so that the shutter 43 can now be "closed" by cocking up the shutter lever 49.

Such a safety mechanism can entirely prevent the accidents as already described.

Further, in the device of the present embodiment, the operation of bringing the shutter 43 from its "open" position to its "closed" position is automated to simplify the manipulation. The shutter lever 49 is normally biased leftwardly in FIG. 10, namely, in a direction to bring the shutter 43 into "closed" position. Thus, in the cleaning position of the device, the bent end $54_2$ of the link is urged against the knob end portion $50_1$ to "open" the shutter 43, but when the knob 50 is lifted to raise the blade 16, the intereference of the bent end portion $54_2$ of the link is eliminated to permit the shutter lever 49 to be rotated counter-clockwise by the force of the spring 55, whereby the shutter is automatically brought to its "closed" position. This simplifies the operation and also prevents the risk of the toner reserved in the cleaning device dropping to contaminate the apparatus interior and its environment when the operator forgets to close the shutter 43 during mounting or dismounting of the cleaning device or the photosensitive drum 20. It will be noted that this shutter mechanism is applicable for the opening portion not only in the blade cleaning device of the present invention but also in other types of cleaning device, and also as the toner scatter preventing mechanism during inoperative condition of the developing device.

Figure 13:
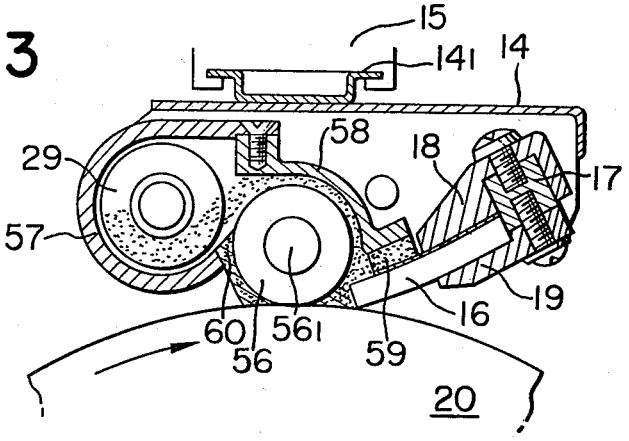
FIG. 13 is a cross-sectional view illustrating another embodiment of the present invention.
Figure 14:
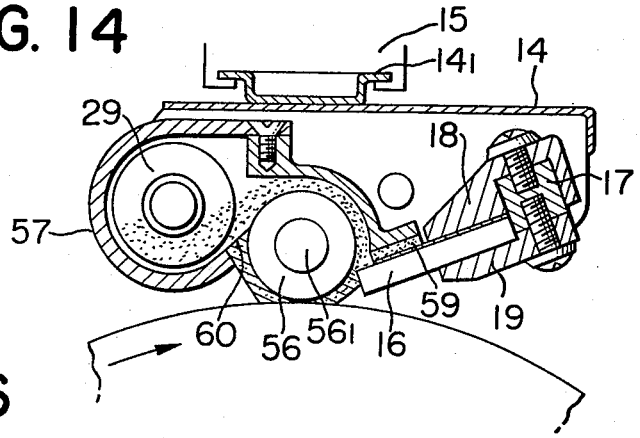
FIG. 14 illustrates the inoperative conditions of such embodiment.

FIGS. 13 and 14 are cross-sectional views illustrating a modified form of the device. In the embodiment shown there, the guide member is in the form of a roller and the blade serves also to perform the function of the shutter. The members similar to those in the previous embodiment are given similar reference numerals. The guide roller 46 disposed adjacent to the blade 16 may be formed of rubber or synthetic resin, for example, Delrin, and is pivotally supported by a shaft $56_1$. The guide roller may preferably rotate at a velocity substantially equal to that of the photosensitive medium 20. A conveyor screw 29 for laterally conveying the developer extends substantially parallel to the roller. Members 57 and 58 together define a passage space leading from a slit opening, formed by the roller 56 and the blade 16, to the screw 29. Disposed in the gap between the pivotally supported blade 16 and the member 58 is a seal member 59 formed of a material such as sponge or the like having a high compression deformation factor, while a seal member 60 formed of Mylar or like material is disposed in the gap between the guide roller 56 and the member 57, thus providing good sealing for the conveyance passage space. With such construction, the developer separated from the surface of the photosensitive medium by the blade may be moved along the passage for collection. On the other hand, when the blade is pivoted to its inoperative position, as shown in FIG. 14, the blade edge portion makes intimate contact with the surface of the guide roller to close the slit opening completely. Thus, the blade, when maintained in its inoperative position, performs the function of the shutter and eliminates the risk of the collected developer leaking and scattering during the mounting or dismounting of the device, just as in the previous embodiment.

The guide member is disposed in proximity to or in intimate contact with the surface of the photosensitive medium but the guide member may preferably be designed to be movable away from the surface of the photosensitive medium, in order to facilitate the mounting or dismounting of the device.

Figure 16:
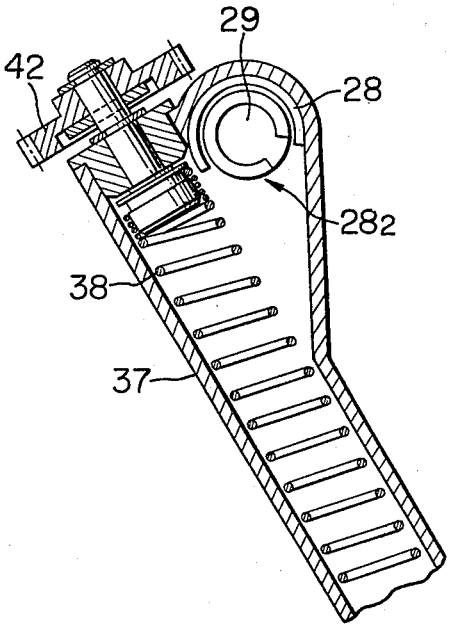
FIG. 16 is a cross-sectional view taken along line D—D in FIG. 15.
Figure 15:
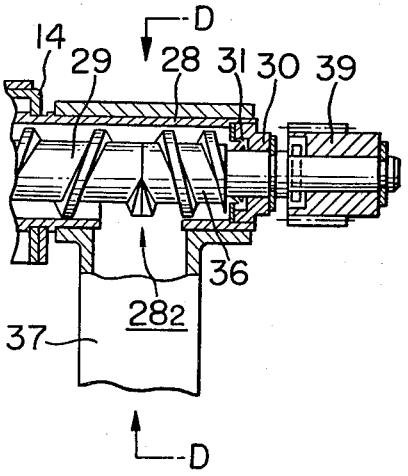
FIG. 15 is a front sectional view of the developer discharge portion.

Reference will now be had to FIG. 15 and 16 to describe a mechanism whereby the toner removed by the present cleaning device may be directed to the developing section.

A pipe 28 extends outwardly through the casing 14 at the front thereof and has a discharge port $28_2$ thereat. A screw 29 within the pipe 28 extends to the vicinity of the discharge port $28_2$, and is succeeded by a screw 36 threaded oppositely to the screw 29 to ensure positive discharge into the discharge port $28_2$. A bearing 30 and a seal 31 are provided at the front end of the pipe 28 to support the screws 29 and 36, and this is also the case with the rear end of the pipe 28.

A collecting duct 37 is removably fitted over the outwardly projected portion of the pipe 28 to cause the toner discharged through the discharge port $28_2$ of the pipe 28 to be directed to the developing section from gravity. The toner tends to scatter upwardly when delivered from the pipe 28 into the collecting duct 37, but the sufficiently close fit of the collecting duct 37 to the pipe 28 prevents the upwardly scattered toner from leaking outwardly to contaminate the environment.

Since the collecting duct 37 is somewhat inclined with respect to the vertical because of the arrangement of the cleaning and the developing section, toner may possibly be deposited on the inner wall of the collecting duct 37 and even clog the duct to cause some accident. For this reason, a coil spring 38 is provided and rotated within the collecting duct 37 to assist in conveying the toner, thereby preventing deposition of the toner onto the inner wall of the duct. The rotative drive for the coil spring 38 may be transmitted by converting an axial drive into a vertical drive through such means as a bevel gear 39 on the forward end of the screw shaft of the cleaner, an unshown bevel gear 40, an unshown spur gear 41 and a spur gear 42.

According to the present invention, as noted above, a seal 34 is provided at the opposite ends of the gap between the blade 16 and the guide plate 21 so that all the removed toner may be forced upwardly into the space $33_1$ completely sealed except for the inlet and outlet, from which the toner may be discharged. Thus, no toner leaks from either end of the blade or from anywhere else when the device is tilted, and the delivery of the toner to the collector device can occur easily and without the toner being scattered during the delivery.

Also, according to the present invention, a shutter mechanism including a shutter 43 for closing the opening portion of the device is provided to prevent dropping of toner within the device during its non-cleaning conditions and thus, no scattering of toner occurs during the mounting or dismounting of the device or of the photosensitive drum 20.

Further, the shutter mechanism of the present invention has a safety mechanism for preventing the resilient blade from being interfered with when in its cleaning position, thus preventing occurrence of such malfunctioning that the shutter closes the slit opening and the blade strikes against the surface of the photosensitive medium. This completely eliminates the possibility that the shutter may be closed during the cleaning operation to prevent the developer separated by the blade from being removed from the vicinity thereof and to permit such developer to build up there to reduce the cleaning efficiency or impart to the blade and/or the surface of the photosensitive medium any abnormal load which would result in damages thereof.

Further, the automatic shutter closing mechanism is useful to eliminate the occurrence of the risk of toner being scattered during the mounting or dismounting of the cleaning device or of the photosensitive medium.

The device of the present invention, as has hitherto been described in detail, performs the cleaning operation by the use of a resilient blade and this contributes to a very compact construction of the device.

Moreover, the set position of the device may be arbitrarily selected by the use of the blade and the guide member and this means a great advantage when the present invention is applied to copying machines.

Furthermore, the device of the present invention is constructed with a good sealing effect maintained and thus eliminates the risk of the removed developer being scattered and contaminating the interior and exterior of the apparatus. In addition, the collected developer may be conveyed back into the developing device for reuse and this means highly efficient recycling and economy of the material.

What is claimed is:

1. A cleaning device for use with an electrophotographic machine having a movable image bearing member for bearing a developed image formed in accordance with an electrostatic image, the image bearing member being reusable after the developed image is used and the image bearing member is cleaned, said device comprising:

cleaning means for removing developer from a surface of the image bearing member, said means including a cleaning member which extends transversely with respect to the direction of movement of the image bearing member;

means for transporting the developer removed by said cleaning means away from the image bearing member along said transverse direction thereof;

means defining a passage for leading the developer transported by said transporting means to means for collecting developer; and means for preventing the deposition of the removed developer on said passage means, said preventing means including a helical member rotatable about an axis extending substantially along said passage means.

2. A device according to claim 1, wherein said passage means includes a duct.

3. A device according to claim 1, wherein said helical member is rotated for deposition prevention by a driving force derived from means for driving the image bearing member.

4. A device according to claim 1, wherein said cleaning member includes a resilient cleaning blade.

5. A device according to claim 4, wherein said transporting means transports the removed developer along said resilient cleaning blade.

6. A device according to claim 1, wherein said passage means is engageable with and disengageable from said transporting means.

7. A device according to claim 1, wherein said transporting means is driven by means for driving the image bearing member.

8. A device according to claim 5, wherein said transporting means is driven by means for driving the image bearing member.

9. A cleaning device for use with an electrophotographic machine having a movable image bearing member for bearing a developed image formed in accordance with an electrostatic image, the image bearing member being reusable after the developed image is used and the image bearing member is cleaned, said device comprising:

cleaning means for removing developer from a surface of the image bearing member, said means including a cleaning member which extends transversely with respect to the direction of movement of the image bearing member;

means for sealing an end of said cleaning member;

means for transporting the developer removed by said cleaning means away from the image bearing member in the transverse direction thereof;

means defining a passage for leading the developer transported by said transporting means to means for collecting developer; and means for preventing the deposition of the removed developer on said passage means, said preventing means including a helical member rotatable about an axis extending substantially along said passage means.

10. A device according to claim 9, wherein said cleaning member is movably supported.

11. A device according to claim 9, wherein said sealing means comprises a soft cylindrical member which encloses said transporting means.

12. A cleaning device for use with an electrophotographic machine having a movable image bearing member for bearing a developed image formed in accordance with an electrostatic image, the image bearing member being reusable after the developed image is used and the image bearing member is cleaned, said device comprising:

cleaning means for removing developer from a surface of the image bearing member, said means including a resilient cleaning blade which extends transversely with respect to the direction of movement of the image bearing member;

a guide member which cooperates with said resilient cleaning blade to form a slit opening;

means for sealing a lateral end of said slit opening;

means for transporting the developer removed by said cleaning means away from the image bearing member in the transverse direction thereof;

means defining a passage for leading the developer transported by said transport means to means for collecting developer; and means for preventing the deposition of the removed developer on said passage means, said preventing means including a helical member rotatable about an axis extending substantially along said passage means.

13. A device according to claim 12, wherein said passage means includes a duct.

14. A device according to claim 12, wherein said helical member is rotated for deposition prevention by a driving force derived from means for driving the image bearing member.

15. A device according to claim 12, wherein said transporting means transports the removed developer along said resilient cleaning blade.

16. A device according to claim 12, wherein said passage means is engageable with and disengageable from said transporting means.

17. A device according to claim 12, wherein said transporting means is driven by means for driving the image bearing member.

18. A device according to claim 15, wherein said transporting means is driven by means for driving the image bearing member.

19. A device according to claim 12 or 17, wherein said resilient cleaning blade is movably supported.

20. A device according to claim 12 or 17, wherein said guide member is movably supported.

21. A device according to claim 12 or 17, wherein said transporting means transports the removed developer substantially along the slit opening.

22. A device according to claim 12 or 17, wherein said sealing means comprises a soft cylindrical member which encloses said transporting means.

23. A device according to claim 21, wherein said sealing means comprises a soft cylindrical member which encloses said transporting means.

24. A device according to claim 1, 9 or 12, wherein said collecting means is a reservoir for the developer.

25. A device according to claim 1, 9 or 12 wherein said preventing means is interrelated with said transporting means.

26. A device according to claim 1, 9 or 12, wherein said helical member is a coil spring provided in said passage means.

27. A device according to claim 1, 9 or 12, wherein said passage means is located adjacent to a lateral end of the image bearing member.

* * * * *

UNITED STATES PATENT AND TRADEMARK OFFICE

CERTIFICATE OF CORRECTION

PATENT NO. : 4,323,306

DATED : April 6, 1982

INVENTOR(S) : YOSHIO ITO, ET AL.

It is certified that error appears in the above—identified patent and that said Letters Patent is hereby corrected as shown below:

Column 3, line 5, "requird" should read --required--.

Column 4, line 67, "exaple" should read --example--.

Column 6, line 51, "know" should read --knob--.

Column 7, line 34, "intereference" should read --interference--
line 56, "46" should read --56--.

Column 8, line 22, "FIG." should read --FIGS.--.

Column 9, line 5, "conditions" should read --condition--.

Signed and Sealed this

*Fifth* Day of *October 1982*

[SEAL]

*Attest:*

GERALD J. MOSSINGHOFF

*Attesting Officer*

*Commissioner of Patents and Trademarks*